United States Patent [19]

Hartopp

[11] Patent Number: 4,977,872

[45] Date of Patent: Dec. 18, 1990

[54] INJECTOR CLEANING/TESTING APPARATUS

[75] Inventor: Robert Hartopp, Coventry, England

[73] Assignee: Automated Engineering Systems Limited, Coventry, United Kingdom

[21] Appl. No.: 418,191

[22] Filed: Oct. 6, 1989

[30] Foreign Application Priority Data

Oct. 8, 1988 [GB] United Kingdom ..... 8823693

[51] Int. Cl.[5] ..... B08B 3/08; F02B 77/00

[52] U.S. Cl. ..... 123/198 A; 73/119 A; 134/169 A

[58] Field of Search ..... 123/198 A; 73/119 A; 134/169 A

[56] References Cited

U.S. PATENT DOCUMENTS

| | | | |
|---|---|---|---|
| 4,404,847 | 9/1983 | Larson | 73/119 A |
| 4,520,773 | 6/1985 | Koslow | 123/198 A |
| 4,606,311 | 8/1986 | Reyes et al. | 134/169 A |
| 4,788,858 | 12/1988 | Liebermann | 73/119 A |
| 4,804,005 | 2/1989 | Hartopp | 134/169 A |

*Primary Examiner*—Noah P. Kamen

*Attorney, Agent, or Firm*—Gifford, Groh, Sprinkle, Patmore and Anderson

[57] ABSTRACT

Injector cleaning/testing apparatus is arranged to enable electrically actuated injectors to be cleaned and tested while in situ on an engine. The apparatus is connected to the fuel supply system of the engine which feeds fuel and/or cleaning fluid to the engine injectors. Measuring means is also provided for measuring the rate of flow of fuel through the injectors. Fuel is pumped to pressurize the supply of fuel to the injectors; the pressure is measured and the rate of change of the pressure is determined as an injector is opened thereby determining the rate of flow through the injector. The apparatus also includes an arrangement whereby the engine fuel supply pump is used during cleaning and an arrangement by which the injectors may be actuated in different modes without disconnection.

9 Claims, 7 Drawing Sheets

INJECTOR CLEANING/TESTING APPARATUS

BACKGROUND OF THE INVENTION

This invention relates to apparatus for cleaning and testing fuel injectors particularly, but not exclusively the fuel injectors of internal combustion engines.

Fuel injectors, particularly electrically actuated fuel injectors of internal combustion engines, become coated on their surfaces which are in contact with the fuel and this impairs the efficiency of the injectors. Hitherto such injectors have proved difficult to clean and often it has been found necessary to discard the injectors rather than clean them.

In some cases cleaning has been effected by removing the injectors from the engine and subjecting them to a cleaning operation. However the removal and replacement operations are time consuming. Accordingly it has been proposed in British patent specification No. 2117048 to clean and test the injectors while they remain in situ on the engine. An object of the invention is to provide improvements and modifications to such earlier proposals.

SUMMARY OF THE INVENTION

According to the invention injector cleaning/testing apparatus comprises supply means for connection with the fuel supply system of a vehicle, the supply means being arranged to feed fuel and/or cleaning fluid to the fuel supply system for discharge through vehicle fuel supply injectors; actuating means for the injectors whereby the injectors are individually actuable; measuring means for measuring the rate of flow of fuel through individual injectors; and control means for controlling the operation of the supply means, the actuating means and the measuring means; the measuring means including pump means for pressurizing the supply of fuel to the injectors, valve means for isolating the pressurized fuel supply, and pressure measuring means for measuring the pressurized fuel supply to the injectors, the pressure measuring means being coupled to calculating means whereby the rate of change of pressure detected by the measuring means is calculated so that when the valve means is operated and an injector is actuated to an open condition to pass the pressurized fuel therethrough the calculating means provides a signal according to the rate of change of the fuel pressure which corresponds to the rate of flow of fuel through the injector.

Preferably the measuring means includes pressure regulating means whereby the fuel pressure in the supply to the injectors is at a predetermined value prior to actuation of the selected injector.

Conveniently the control means is arranged to operate the actuating means to open the injector for a predetermined period, for example two or three seconds, during measuring of the rate of flow through the injector.

According to one arrangement the supply means includes container means for containing a cleaning fluid, a fuel line communicating between a fuel pump on the vehicle and the container means, a further fuel line for communicating between the container means and the fuel injectors, and valve means for directing and controlling the flow of fuel and cleaning fluid in accordance with the operation of the control means, whereby fuel from the vehicle fuel pump is arranged to cause the cleaning fluid in the container to pass through and clean the injectors and fuel and operate the engine.

Preferably the fuel line to the container means includes a regulator which regulates the pressure in the fuel by returning excess fuel from the pump to the vehicle fuel supply tank.

The control means for the injector is preferably capable of energising the injector in an open/closed cycle equivalent to its normal operating mode during engine running, and/or to a constantly open condition.

According to a preferred arrangement the injector actuating means comprises electrical connection means for connection to the electrical contacts of each injector, a source of electrical power communicating with the connector, switch means for connecting the connector selectively with electrical control and supply means of the vehicle with which each injector is normally associated or with other control means whereby each injector can be individually actuated and controlled according to the desired mode of operation of the injector without disconnection of the electrical connection means from each injector.

Conveniently the apparatus includes electrical display means whereby the rate of flow indication provided by the calculating means is visually displayed.

The energising means usually takes the form of a harness for engines with multiple injectors, each injector having an electrical connector attachable to its contacts and each electrical connector being associated with switch means for that connector. Thus during flow measurement the individual injector to be tested may be energised and the other injectors deenergised by operation of the respective switch means. During a cleaning operation all the injectors may be electrically connected to the engine injector control system through said harness by operation of the switch means.

BRIEF DESCRIPTION OF THE DRAWINGS

Further features of the invention will appear from the following description of an embodiment of the invention given by way of example only and with reference to the drawings, in which.

DESCRIPTION OF A PREFERRED EMBODIMENT

Figure 1A:
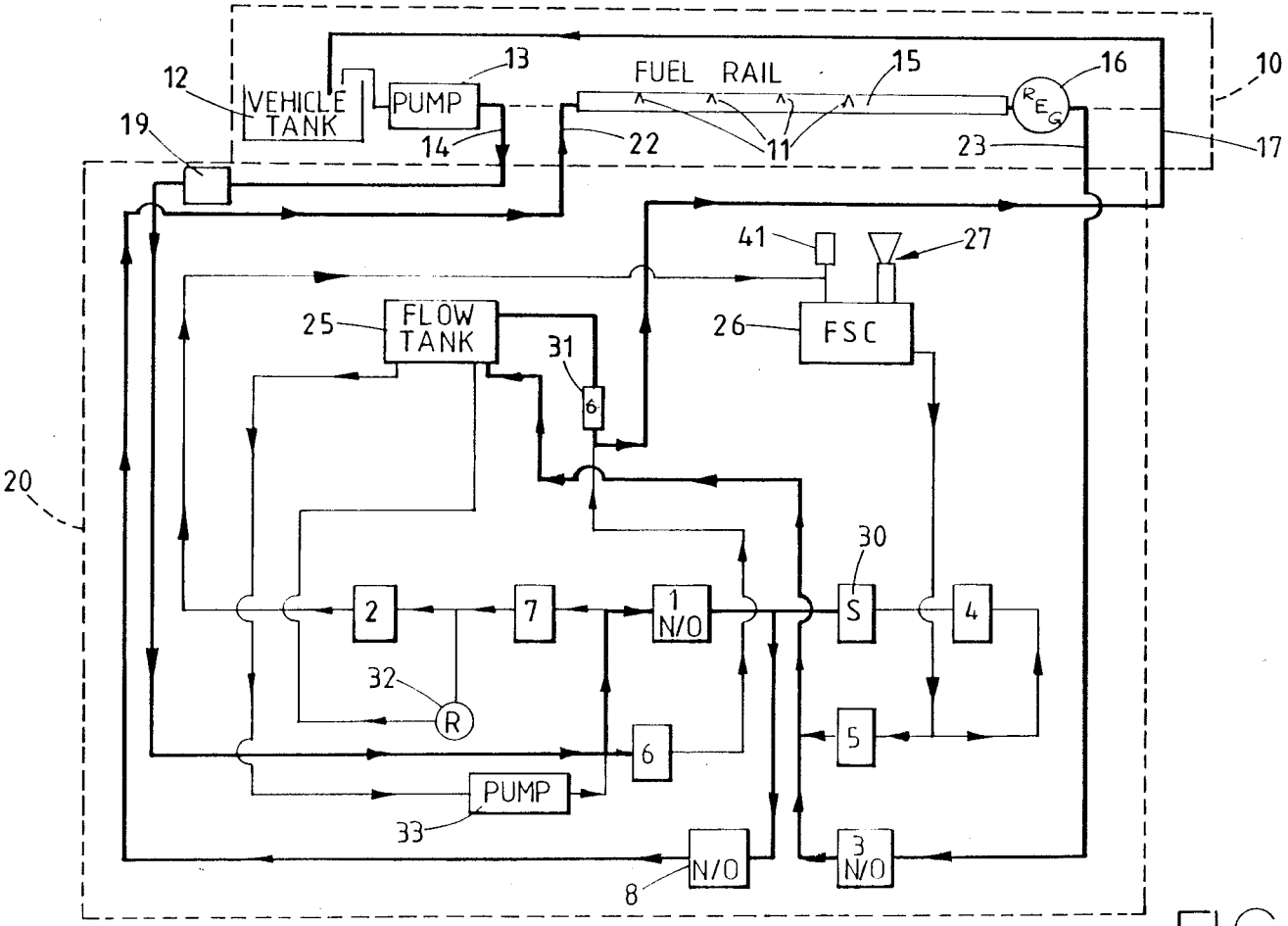
FIG. 1A shows schematically a circuit diagram of an injector cleaning system showing the fluid path in the normal running condition of a vehicle engine with which it is associated.
Figure 1B:
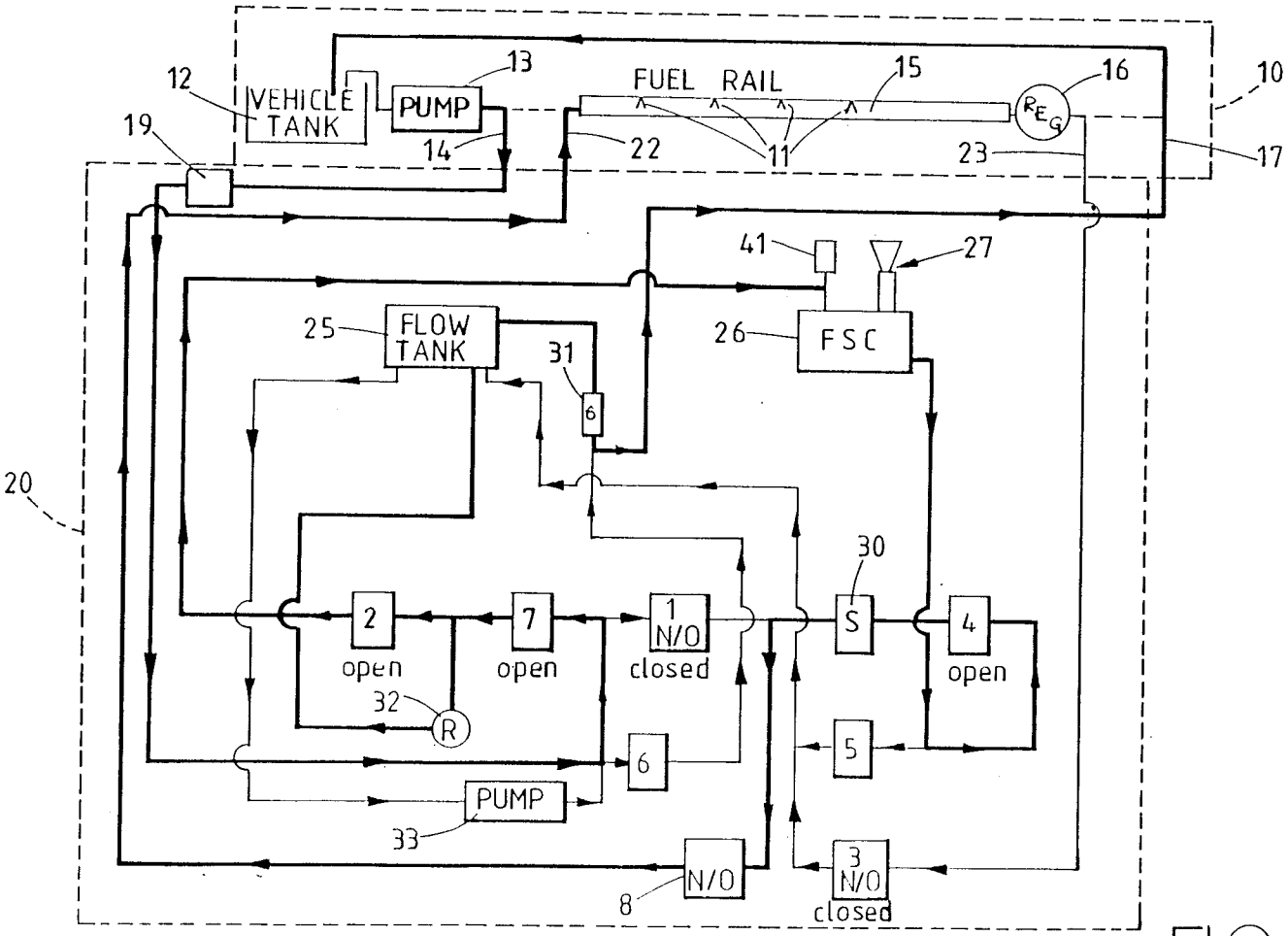
FIG. 1B shows the diagram of FIG. 1A indicating the fluid path in the injector cleaning cycle of the system.
Figure 1C:
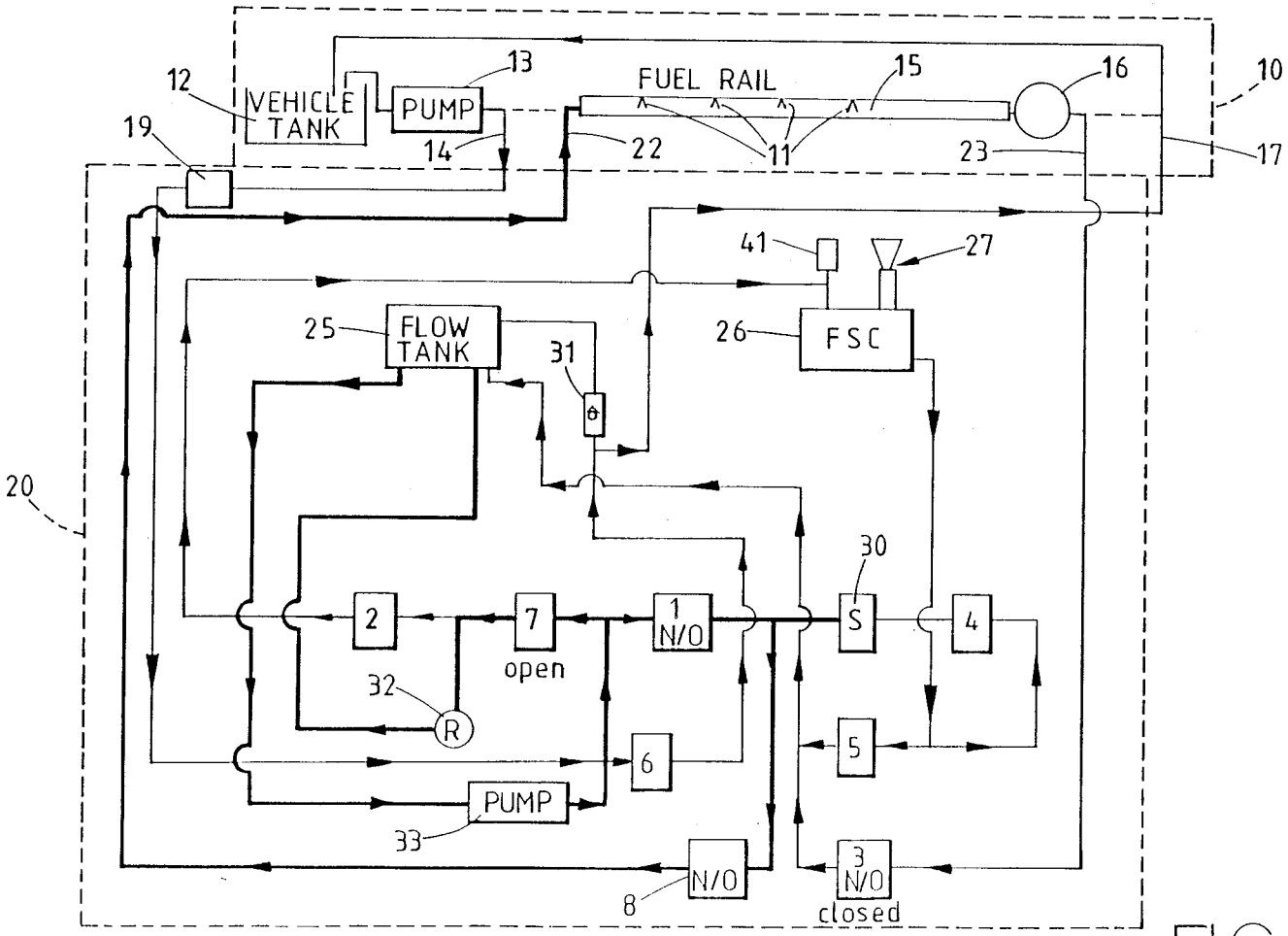
FIG. 1C shows the diagram of FIG. 1A indicating the fluid path in the flow rate measuring cycle of the system.
Figure 1D:
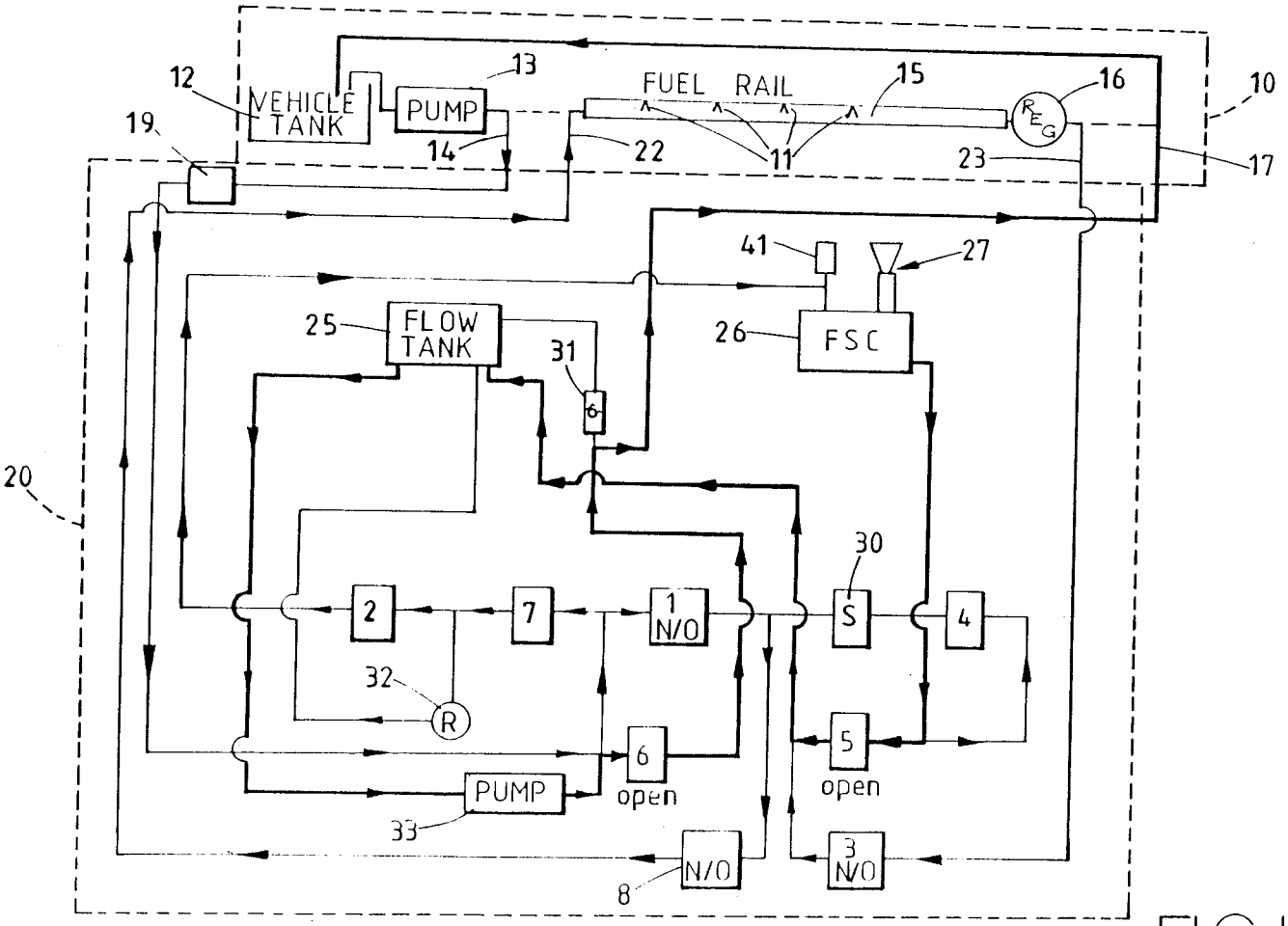
FIG. 1D shows the diagram of FIG. 1A with the fluid path during the emptying of the system indicated.
Figure 2:
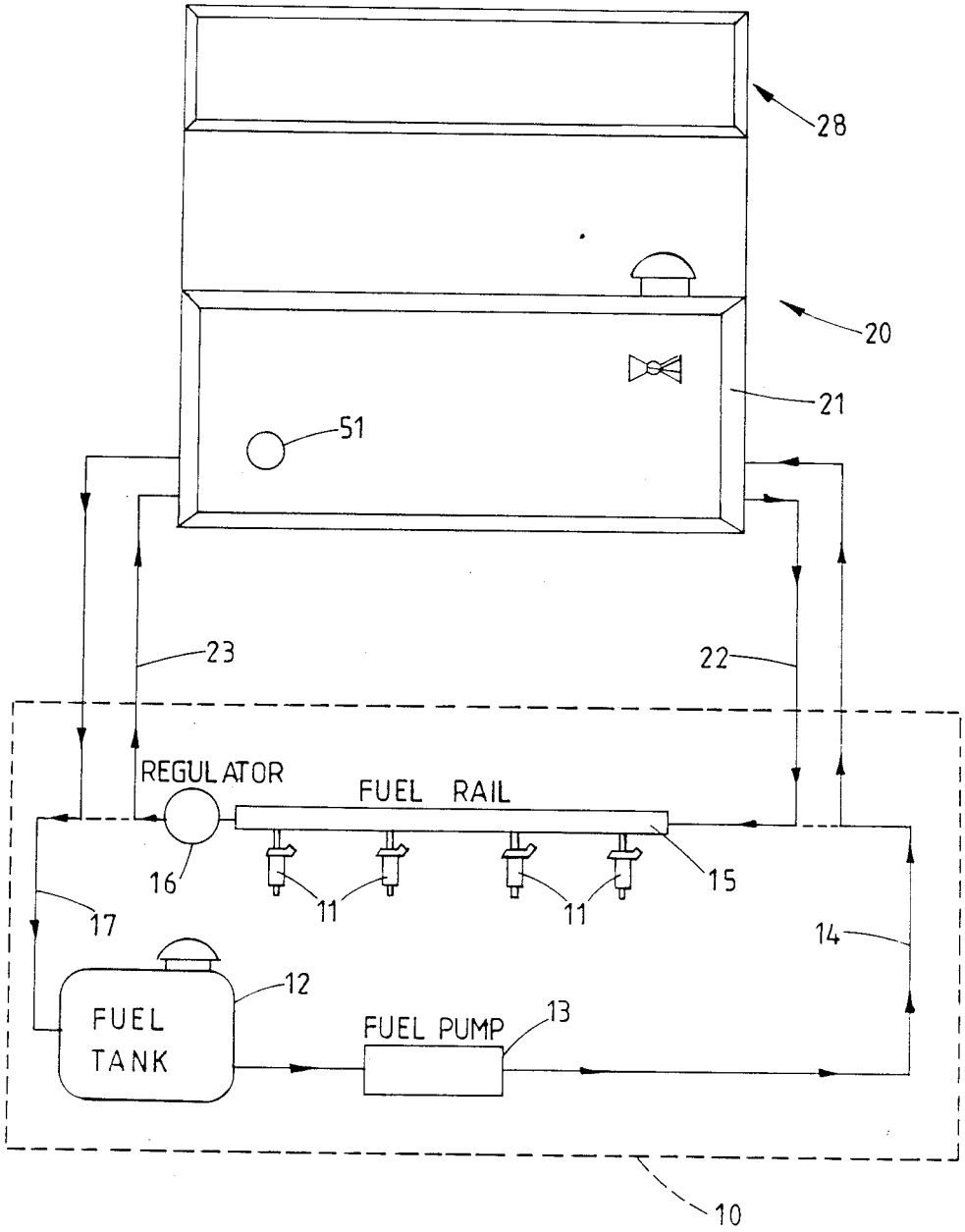
FIG. 2 shows diagrammatically the association of the vehicle with the system of FIGS. 1A and 1D.

Referring to FIGS. 1A–1D and to FIG. 2 an injector cleaning system utilises, in part, the vehicle fuel supply system 10 in order to enable the fuel injectors 11 to be cleaned and checked as to flow rate while they remain in situ in an operative position on the engine (not shown), usually a vehicle engine. In this case the engine has four fuel injectors but the system is equally applicable to engines having different numbers of injectors, one for each cylinder. The fuel injectors are of the kind which are electrically actuated to open and close in response to engine requirements. Control of the injectors in use of the engine is by an electrical control system (not shown) associated with the engine and connected by leads (FIG. 4) to the injectors.

The engine fuel supply system 10 includes a fuel tank 12 and a fuel pump 13 mounted on the vehicle and normally connected through a fuel line 14 with a fuel rail 15 carried on the engine. From the fuel rail 15 the fuel is directed to the injectors 11 and fuel passes through the open injectors 11 into the engine cylinders. The fuel pump 13 normally supplies in excess of the requirements of the injectors and a regulator 16 is provided downstream of the injectors to ensure an adequate predetermined pressure of fuel in the fuel rail 15 and that excess fuel is returned, normally to the fuel tank 12, through a return line 17.

In the use of the cleaning system the fuel supply from the fuel pump 13 is led to cleaning apparatus 20 housed in a housing 21 and the return line 17 is also connected to the apparatus. Thus fuel from the pump 13 can pass to the apparatus 20 and the apparatus can return any excess fuel to the tank 12. In addition the apparatus 20 includes a fuel line 22 to the fuel rail 15 and a return line 23 from the fuel rail to the apparatus 20.

Referring now particularly to FIGS. 1A–1D the apparatus 20 includes circuitry for feeding fuel and/or cleaning fluid to and from the fuel rail 15. The apparatus also provides the facility for emptying the apparatus of fuel.

In the circuitry is located a sealed fuel tank 25 and a tank 26 for cleaning fluid for cleaning the injectors 11. The cleaning fluid tank 26 includes inlet means 27 whereby cleaning fluid can be poured into the tank through a valve.

The apparatus also includes normally closed valves 2, 4, 5, 6 and 7 and normally open valves 1, 3 and 8; each of the valves being controlled to open or close by electrically-operated control means contained within a housing 28 of the apparatus 20, as will be described.

The circuit includes a sensor 30 for sensing the pressure of fluid in the circuit at the location of the sensor and the sensor is electrically-connected to the control means in the housing 28. A one-way valve 31 is also provided together with a pressure regulator 32. A pump 33 is located in the circuit to pump liquid through the circuit when the flow rate through the injectors 11 is to be measured and when the system is emptied.

A fuel pump flow meter 19 is also provided to measure the rate of flow from the pump 13.

The circuit is best described in relation to each of the operative steps of the system in each of which steps liquid passes along a different path through the circuit dependent on the operation of the various valves 1–8. For the operation steps it is assumed that the fuel inlet and outlet lines to the fuel rail 15 are disconnected and the apparatus 20 is connected, as shown.

The apparatus can be used to effect normal running of the engine i.e., the engine can be run without any cleaning or flow rate measurement of the injectors. During this phase the vehicle pump 13 is employed and the regulator 16 is operative so that it may be checked if these items are faulty. Moreover during this phase all the valves 1–8 are deenergised.

With the fuel pump 13 operative fuel from the tank 12 passes along the fuel line 14 into the apparatus 20. The fuel then passes to the fuel rail 15 after passing through the valve 1. Excess fuel from the fuel rail 15 passes through the regulator 16 through the valve 3 to the tank 25 to fill the tank 25 and then through the one-way valve 31 back into the vehicle fuel tank 12. This path is as shown by thickened lines in FIG. 1A. During this phase the sensor 30 acts to sense the fuel rail pressure and can, therefore, determine whether the regulator 16 and/or pump is operating correctly and at the desired pressure setting for the vehicle concerned. Similarly the flow meter 19 determines the pump 13 flow rate.

Prior to operating a cleaning phase for the injectors the injectors may be individually tested to ascertain whether these flow rate characteristics are as required. Alternatively flow rate checking may be conducted only after an injector cleaning cycle has been performed.

A cleaning cycle is conducted by first filling up the cleaning fluid tank 26 with cleaning fluid. The fuel pump 13 is energised together with valves 1, 2, 3, 4 and 7. Fuel from the tank 12 is passed through the valves 7 and 2 to the tank 26. Entering the tank 26 the fuel causes pressurization of the tank and the cleaning fluid in the tank to leave and pass through valve 4 to the fuel rail 15. The injectors 11 are, during this phase, connected for normal operation by the vehicle injector controls and the cleaning fluid is therefore injected into the engine so that it runs normally, the cleaning fluid also acting as fuel for the engine as well as cleaning the injectors by its passage therethrough.

Since valve 3 is closed the cleaning fluid cannot pass along line 23. Any excess pressure in the fluid is dealt with by the regulator 32. Excess fuel pressure causes the regulator 32 to bleed fuel to the tank 25 from where it flows through the one-way valve 3 and then back to the fuel tank 12.

Flows through the circuitry during cleaning are shown in FIG. 1B by thickened lines.

As the cleaning cycle progresses, after an initial period during which substantially pure cleaning fluid passes through the injectors 11, there follows a period when a mixture of fuel and cleaning fluid is used in the engine. During a final period, while cleaning fluid is flushed from the circuit, there is for a short time fuel only passing to the engine. Normally the cleaning cycle is allowed to continue for a predetermined period of, say ten minutes, to effect complete cleaning of the injectors 11. It will be appreciated that the engine is run off the vehicle fuel pump and the vehicle injector control system, in a substantially normal operating mode, during cleaning.

After cleaning the flow rate of each of the injectors may be tested to check whether the cleaning operation was successful. The flow rate cycle is illustrated in FIG. 1C and utilises the pump 33 of the apparatus instead of the vehicle fuel pump 13. Valves 7 and 3 are energised by the control system so that fuel in the tank 25 is pumped by the pump 33 through the valve 1 (when open) to the fuel rail 15. Due to the valve 3 being closed the fuel cannot pass out of the return line 23 from the fuel rail 15. The pressure of the fuel to the rail 15 is controlled by the regulator 32 and excess pressure is relieved through the valve 7 and the regulator 32 back to the fuel tank 25. It will be noted that the sensor 30 is also in fluid communication with the fuel passing to the fuel rail 15.

Figure 3:
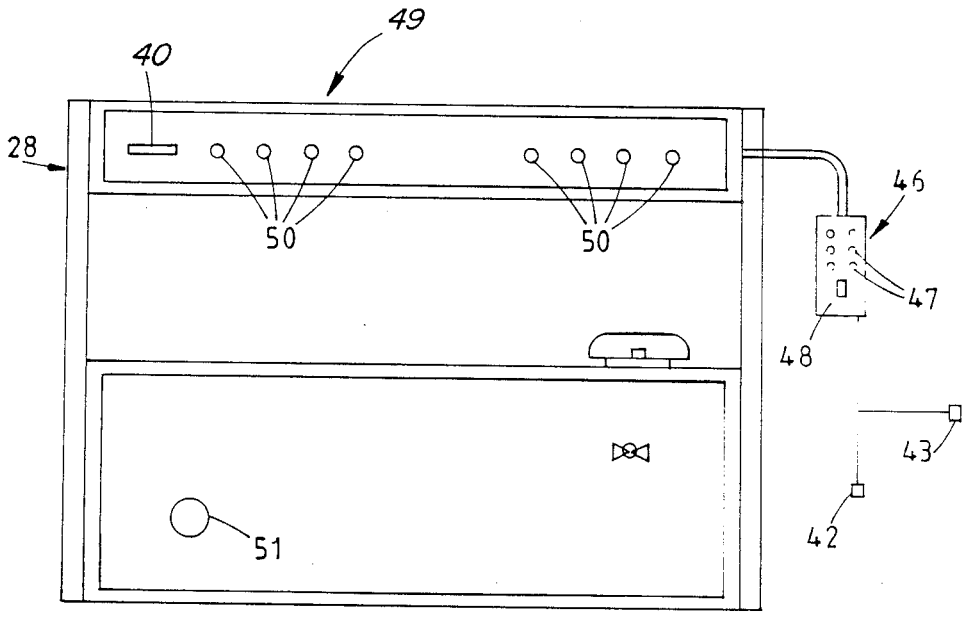
FIG. 3 shows diagrammatically an external view of the injector cleaning apparatus.

In order to check the flow rate in a particular injector 1 pressure is set up, as described, in the fuel rail 15 and when the pressure has settled to a predetermined level, determined by the setting of the regulator 32, the valve 1 is energised and closed, the selected injector 11 is opened for a predetermined time of, say 2–3 seconds. During this time interval fuel is passed through the injector 11 and a pressure drop occurs in the fuel line to the injector. The pressure sensor 30 records the pressure drop over this time interval and signals the pressure drop to electronic calculating means (not shown) of known form. The calculating means compares the pressure drop recorded with a calibrated amount to give an output signal indicating the flow rate through the selected injectors. The output signal is displayed on a visual display 40 on the apparatus (FIG. 3). The valve 1 can then be deenergised for a repeat flow rate measurement on another injector.

The flow rate measurement on each injector may be conducted by opening the injector throughout the pressure drop sensing operation (static test) or by actuating the injector in its dynamic mode i.e., by a rapid opening and closing sequence, as in normal engine operation. This is achieved by the control means to be more fully described.

The flow rate measurement cycle is repeated on each of the injectors in turn until all have been tested. The tests determine for the operator which, if any, of the injectors is defective or inadequately cleaned.

Referring now to FIG. 1D the apparatus is emptied of remaining fuel after the cleaning and testing cycles by energising the pump 33 and the valves 5 and 6. Fuel is pumped from the tank 25 through the valve 6 to the vehicle tank 12 since this path presents the easiest route for the fuel. However since the tank 25 is closed to atmosphere first fuel and then air is admitted to the tank through the valve 5 from the cleaning fluid tank 26 which is provided with an air vent 41.

The apparatus is also able to test for the efficiency of the vehicle fuel pump 13. In this mode (not illustrated) the valves 3 and 7 are energised so that valve 3 is closed and valve 7 is open. Valve 8 is energised to close to prevent fuel passing to the fuel rail 15. Thus fuel pressure from the pump is directly transmitted to the sensor 30 which is therefore able to detect pressure which compares the pump 13 efficiency against a rated value.

A further test is possible which is to test for fuel leakage in the injectors 11. In this case valves 3 and 7 are energised to set up fuel pressure in the fuel rail 15 with the injectors 22 in the nominally closed position. Valve 1 is then energised to close and the sensor 30 then detects any reduction in the fuel pressure in the fuel rail which indicates that fuel is leaking through one of the injectors 11.

Figure 4:
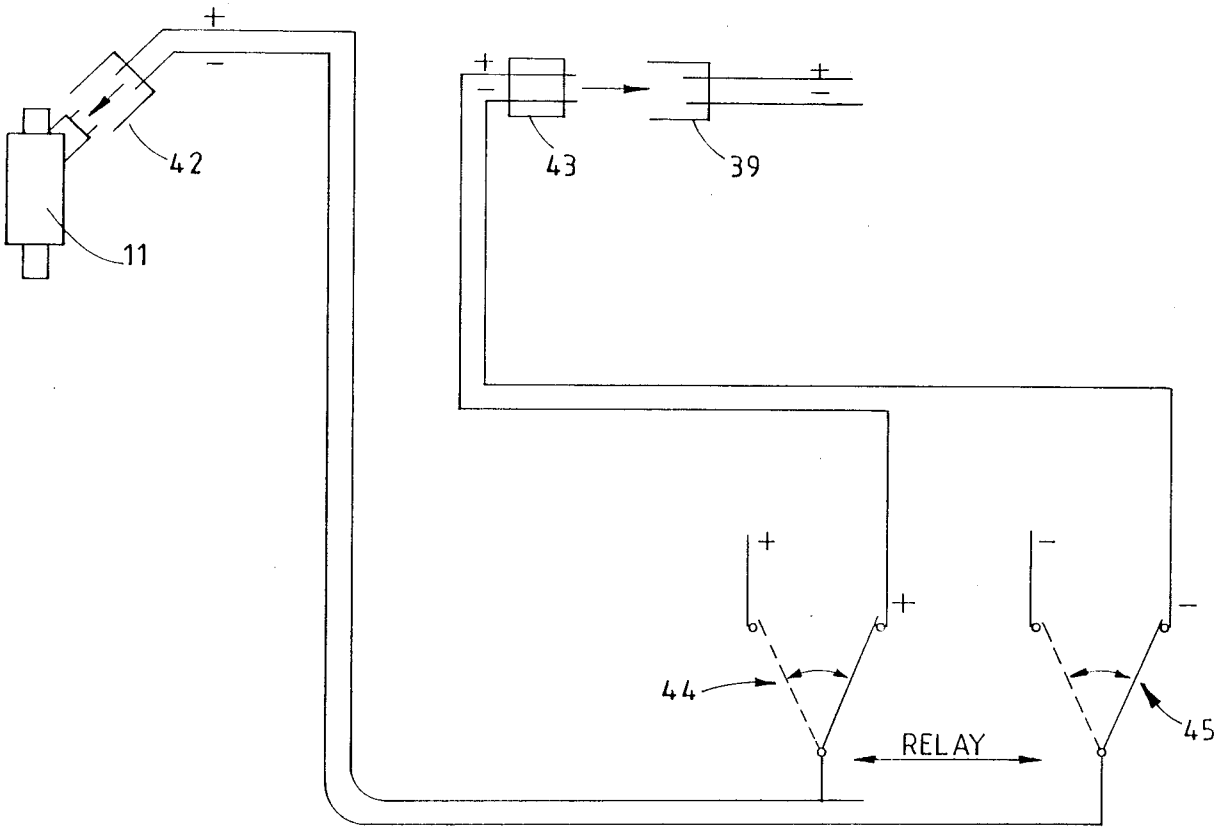
FIG. 4 shows a diagrammatic view of the electrical connections to the injectors from the injector cleaning apparatus.

Referring now to FIGS. 3 and 4 there is shown a control panel 49 for the apparatus and a harness by which the injectors 11 are connected to the control means. Considering first the injector connections a usual plug connector 39 from each vehicle injector control is disconnected from the injector 11 at the commencement of an operation. A connector 42 from harness is instead plugged into the injector and a further connector 43 from the harness is connected to the vehicle connector 39. Relays 44 and 45 are provided whereby the electrical supply for this injector may be switched between that of the vehicle controls and that of the apparatus 20. Thus when in the normal running mode, as during the initial running phase and during the cleaning phase, supply to the ignition is through the vehicle supply. However by operation of the relays 44 and 45 to switch supply to the apparatus 20 each injector can be supplied individually with the required control functions such as closed, static open and dynamic open, through the apparatus control means. For this purpose the apparatus includes relay energising means 46 controlled by switches 47 located either in a housing 48 coupled to the apparatus or by a housing (not shown) in the housing 28 itself.

A control panel 49 on the apparatus houses control switches 50 for the operator to control energisation of the valves 1–8, the pump 33 and the sensor 30 according to the function to be performed. For ease of operation the control means is arranged such that the switches 50 effect a separate phase of the operating cycle such as a cleaning phase, an emptying phase etc.

A control 51 is also provided for adjusting the operational pressure of regulator 32 according to the pressure required for the engine.

It will be appreciated that once the harness is connected up to each of the injectors the injectors can be controlled according to the desired mode without further connections having to be made. Simply by operating the relays 44 and 45 it is possible to energise the injectors or an injector in the necessary manner.

The flow rate for each injector is capable of being measured electrically to give a visual read out to the operator using the system described.

The apparatus offers various features which have been found to be advantageous.

By measuring flow rates through the injectors 11 using the rate of decay of pressure as the fuel flows through the respective injector only small quantities of fuel pass through the injector. Since the engine is not operating during such testing procedure it is important to limit the amount of fuel flow because such fuel passes directly into the engine cylinder and the fuel is potentially damaging to the engine. For example unburnt fuel in the cylinder can wash away lubricant and result in engine damage. In the present case the amount of fuel flowing during the two–three second period required is small. Moreover it has been found that this method of flow rate measurement is accurate and compares favourably with much more expensive flow measurement devices.

Provision for using the vehicle pump during the cleaning phase of the apparatus also has certain advantages. Thus it is ensured that the correct fuel is used in the engine, the apparatus does not have to be separately supplied with fuel giving a safety advantages in the workshop, and fuel remaining in the apparatus after completion of a cleaning and testing operation is readily returned to the vehicle tank.

The harness arrangement whereby the injectors are energised selectively by the control means in the desired mode and sequence enables the cleaning and testing operations to be conducted from the apparatus without the requirement to disconnect or connect any of the injectors once the apparatus is in place.

The apparatus also provides for other testing functions such as vehicle pump operation and injector leakage to be conducted which are otherwise difficult to achieve in vehicle workshops.

I claim:

1. Injector cleaning/testing apparatus comprising supply means for connection with the fuel supply system of a vehicle, the supply means being arranged to feed fuel and/or cleaning fluid to the fuel supply system for discharge through vehicle fuel supply injectors; actuating means for the injectors whereby the injectors are individually actuable; measuring means for measuring the rate of flow of fuel through individual injectors; and control means for controlling the operation of the supply means, the actuating means and the measuring means; the measuring means including pump means for pressurizing the supply of fuel to the injectors, valve means for isolating the pressurized fuel supply, and pressure measuring means for measuring the pressurized fuel supply to the injectors, the pressure measuring means being coupled to calculating means whereby the rate of change of pressure detected by the measuring means is calculated so that when the valve means is operated and the injector is actuated to an open condition to pass the pressurized fuel therethrough the calculating means provides a signal according to the rate of change of the fuel pressure which corresponds to the rate of flow of fuel through the injector.

2. Apparatus according to claim 1 wherein the measuring means includes pressure regulating means whereby the fuel pressure in the supply to the injectors is at a predetermined value prior to actuation of the selected injector.

3. Apparatus according to claim 1 wherein the signal from the calculating means is supplied to a visual display unit which gives a visual indication of the fuel flow rate through the selected injector.

4. Apparatus according to claim 1 wherein the supply means includes container means for containing a cleaning fluid, a fuel line communicating between a fuel pump on the vehicle and the container means, a further fuel line for communicating between the container means and the fuel injectors, and valve means for directing and controlling the flow of fuel and cleaning fluid in accordance with the operation of the control means, whereby fuel from the vehicle fuel pump is arranged to cause the cleaning fluid in the container to pass through and clean the injectors and fuel and operate the engine.

5. Apparatus according to claim 4 wherein the fuel line to the container means includes a regulator which regulates the pressure in the fuel by returning excess fuel from the pump to the vehicle fuel supply tank.

6. Apparatus according to claim 1 wherein the injector actuating means is arranged to actuate the injectors selectively from a closed to a constantly open position or in an open/closed cycle equivalent to the normal injector operation during running of the engine.

7. Apparatus according to claim 1 wherein the injector actuating means comprises electrical connection means for connection to the electrical contacts of each injector, a source of electrical power communicating with the connector, switch means for connecting the connector selectively with electrical control and supply means of the vehicle with which each injector is normally associated or with other control means whereby each injector can be individually actuated and controlled according to the desired mode of operation of the injector without disconnection of the electrical connection means from each injector.

8. Apparatus according to claim 7 wherein the actuating means takes the form of a harness, each injector having an electrical connector attachable to its contacts and each electrical connector being associated with switch means for that connector, each switch means being individually actuable or the switch means all being actuated to connect the injectors to the vehicle injector control means.

9. Apparatus according to claim 1 whereby the control means is adopted to operate the actuating means to open the injector for a period of between two or three seconds during measuring of the rate of flow through the injector.

* * * * *